United States Patent [19]

Garner et al.

[11] 4,323,717

[45] Apr. 6, 1982

[54] FURNACE ELECTRODE CLAMPS

[75] Inventors: Henry C. Garner, Mexborough; Lawrence McGee, Sheffield, both of England

[73] Assignee: British Steel Corporation, London, England

[21] Appl. No.: 162,913

[22] Filed: Jun. 25, 1980

[30] Foreign Application Priority Data

Feb. 7, 1979 [GB] United Kingdom ..... 22881/79

[51] Int. Cl.[3] ..... H05B 7/101

[52] U.S. Cl. ..... 373/101

[58] Field of Search ..... 13/14–17

[56] References Cited

U.S. PATENT DOCUMENTS

| | | | |
|---|---|---|---|
| 2,446,002 | 7/1948 | Fausek et al. | 13/16 |
| 2,716,145 | 8/1955 | Cartoux | 13/16 |
| 2,753,388 | 7/1956 | Bjerkas | 13/16 |
| 3,509,261 | 4/0070 | Phillips . | |
| 3,804,966 | 4/1974 | Winter et al. | 13/16 |
| 4,110,548 | 8/0078 | Dresch et al. . | |

FOREIGN PATENT DOCUMENTS

| | | |
|---|---|---|
| 1185414 | 4/1971 | United Kingdom . |

*Primary Examiner*—Roy N. Envall, Jr.
*Attorney, Agent, or Firm*—Bacon & Thomas

[57] ABSTRACT

A furnace electrode clamp comprises a metallic body portion (3), an electrically insulated U-shaped band (7) mounted for movement about the body and adapted to embrace the electrode (8) and at least one (preferably two) electrode contact piece(s) (13) mounted on the body and against which the electrode is clamped by the band. The or each contact piece is made from highly conductive material and is water-cooled. The small surface over which contact is made enables a high force/unit area to be established at the contact/electrode interface than hitherto and the direct water cooling facility enables higher current densities to be withstood.

9 Claims, 1 Drawing Figure

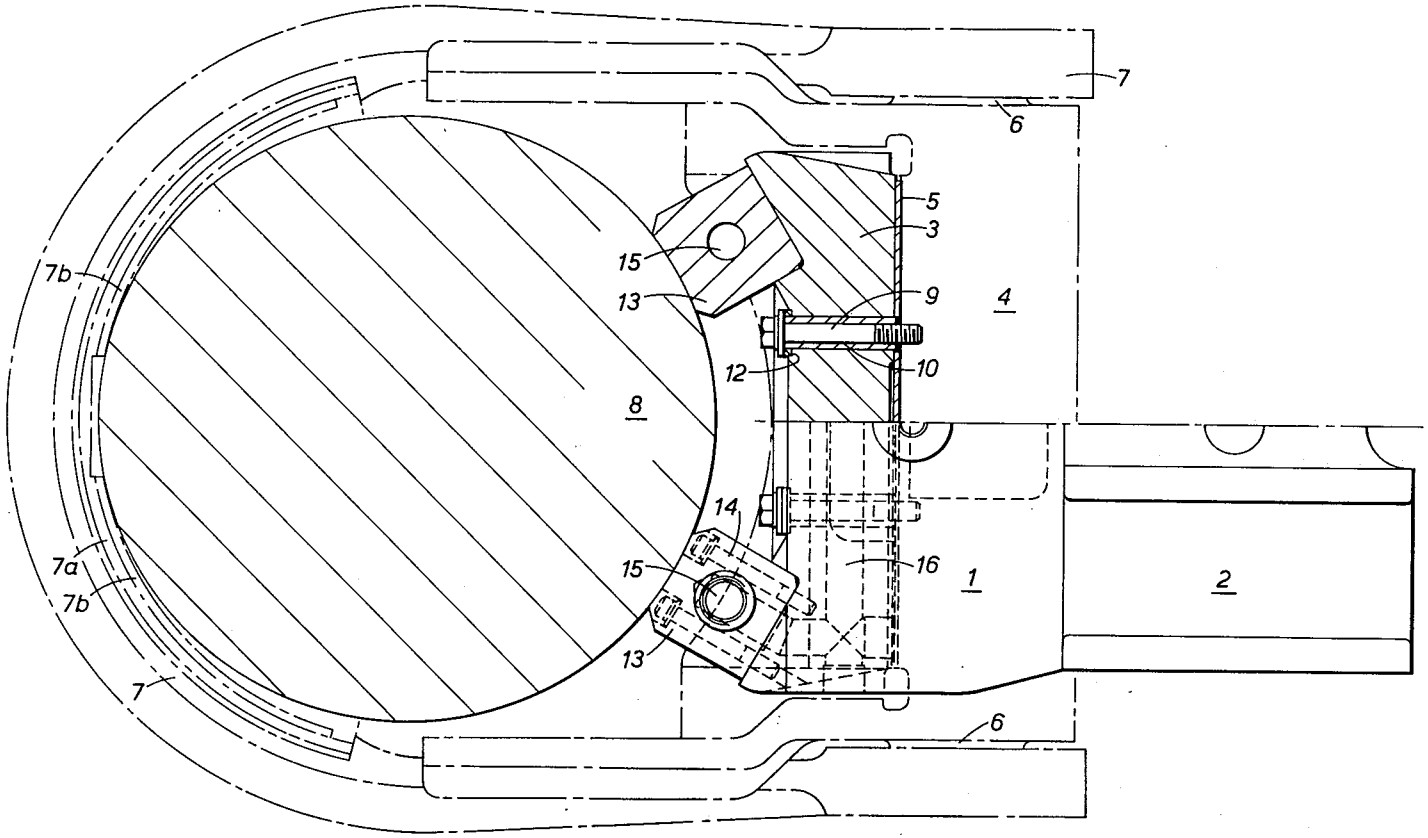
7
6
4
5
3
9
10
12
15
13
8
2
1
16
14
15
13
6
7
7b
7a
7b

FURNACE ELECTRODE CLAMPS

This invention relates to furnace electrode clamps, and more particularly relates to clamps for carbon or graphite electrodes utilised in electric arc furnaces.

In electric arc furnaces power is supplied to the charge through electrodes which are connected through clamps to bus bars carrying the transformer output current. Normally the clamp comprises a copper body portion having a part-cylindrical arcuate surface corresponding to and mating with that of the electrode, the latter being drawn into contact with this surface through a band or yoke which embraces the electrode. Because of the comparatively large expanse of this surface and its arcuate form the contact pressure which can be produced is limited and as a result local arcing can manifest itself which in turn increases the electrical contact resistance and aggravates the situation further. When the electrodes have a surface coating on them to inhibit oxidation as is frequently the case the problem is compounded because the metal of the coating and the copper body can together form a eutectic system again causing local melting and arcing.

Graphite liners have been used to mitigate this problem so that contact is made with the copper body via the liner but this solution is not without drawbacks because the graphite is subject to oxidation which again affects contact resistance. Further, the graphite is liable to fracture and the liners are difficult and expensive to machine into shape.

It is an object of this invention to provide an improved clamp which avoids these drawbacks.

From one aspect the present invention provides a furnace electrode clamp comprising a metallic body portion to which is secured at least one electrode-contact piece against which the electrode is clamped, the or each contact piece being made from highly conductive material having a water-coolant channel extending therethrough and constituting the sole electrical contact between the clamp and the electrode.

From another aspect the invention provides a furnace electrode clamp comprising a metallic body portion to which are secured at least two spaced elongate electrode-contact pieces against which the electrode is clamped, the contact pieces being made from highly conductive material having water-coolant channels extending therethrough and constituting the sole electrical contact between the clamp and the electrode.

The contact pieces themselves may each have part-cylindrical arcuate surfaces which mate with the electrode and they may be made from copper having a particularly high conductivity, e.g. rolled or forged copper; the metallic body may likewise be made from copper.

The electrode may be clamped against the contact pieces in the conventional manner by a U-shaped band mounted for movement on the body and adapted to embrace the electrode but with this invention contact pressures of the order of 40 Kg/sq cm may readily be obtained because these small contacts enable a higher force per unit area to be established at the contact piece/electrode interface and the water cooling enables the higher current densities to be withstood.

In order that the invention may be fully understood one embodiment thereof will now be described, by way of example, with reference to the accompanying drawing which is a part-sectional plan view of the clamp and electrode.

Referring now to the drawing, the clamp comprises an inverted L-shaped copper body 1 to the top of which (2) bus-bar connections are made from the power supply. Mounted behind the lower dependent portion 3 of this body is an austenitic stainless steel member 4, this member being insulated from the body 3 by a mica sheet 5. Two bosses 6 protrude from opposite sides of the body and provide bearings for a stirrup (not shown) which is movable to clamp a hooped steel band 7 into and out of the engagement with the far side of the electrode 8. This band does not carry current since it is insulated by the mica sheet 5 but additionally (or alternatively) an insulating insert pad *7a* may be mounted in the band beneath metallic, e.g. steel, supports *7b*.

The body 3 is secured to the member 4 by bolts 9 which each extend through an insulating sleeve 10 and are clamped against an insulating washer 12 so as electrically to isolate these items 3 and 4.

The body 3 is secured to accommodate two pads 13 made from high conductivity copper and which has been mechanically worked, e.g. forged, to enhance its integrity. The exposed surface of these pads are of part-cylindrical arcuate shape to match the peripheral surface of the electrode against which they bear and they are retained in position by austenitic stainless steel bolts 14.

The body portion 3, and more importantly the pads 13, are water cooled. Each pad has a bore 15 extending downwardly from the top substantially throughout its length issuing adjacent the bottom from the rear side in alignment with a transverse bore 16 in the body 3 which completes the flow circuit i.e. the water flows from a flexible conduit (not shown) through one pad through the bore 16 and then issues through the other pad to be cooled and re-cycled.

Much greater electrode contact pressures may be obtained in accordance with this invention than with conventional designs because, as stated, the smaller contact pads enable a much higher force per unit area to be established at the contact interface with the electrode 8 and the corresponding higher current density can readily be accommodated by the water cooling circuit adopted.

Although the clamp has been described with reference to the particular embodiment illustrated it is to be understood that various modifications may readily be made without departing from the scope of this invention. For example, different configurations of cooling circuit could be adopted, e.g. the water could traverse parallel paths through the pads, as also could the mechanism by which the pads are secured—they could be self supporting and retained by a dovetail or key slot configuration; it is possible furthermore for just a single (central) pad to be provided with say two spaced insulating supports on the band 7 to ensure alignment. The band itself may be split at its mid point—between these supports—and held together here by bolts.

A yet further modification to facilitate alignment is to provide for the body 3 to be split such that each part supports a different one of the pads 13; the two parts may be resiliently connected together to ensure continuity of current conduction and the coolant circuit will also need to be completed of course in the series case.

We claim:

1. A furnace electrode clamp comprising: (a) a metallic body portion; (b) U-shaped band mounted for movement about the body and electrically insulated therefrom and adapted to embrace the electrode; and, (c) an electrode contact piece mounted on the body and against which one side of the electrode is clamped by said band whereby electrical contact is made at that one side only, the contact piece being made from highly conductive material and defining a bore therethrough constituting a water coolant channel.

2. A clamp according to claim 1, in which the contact piece is made from rolled or forged copper.

3. A furnace electrode clamp: (a) a metallic body portion; (b) an electrically U-shaped band mounted for movement about the body and electrically insulated therefrom and adapted to embrace the electrode; and, (c) at least two spaced elongate electrode-contact pieces mounted on the body and against which one side of the electrode is clamped by said band whereby electical contact is made at that one side only, the contact pieces being made from highly conductive material and each defining a bore constituting a water-coolant channel extending therethrough.

4. A clamp according to claim 3, in which the body portion also defines a bore, the water coolant traversing a series path through each contact piece in turn and through said bore in the body which communicates with the bores in the contact pieces.

5. A clamp according to clause 3, in which the water coolant traverses parallel paths through each contact piece.

6. A clamp according to claim 3, in which each contact piece is made from rolled or forged material and has a part-cylindrical surface which mates with the electrode.

7. A clamp according to claim 6 in which each contact piece is made from copper.

8. A clamp according to claim 7, in which each contact piece is secured to the body by austenitic stainless steel bolts.

9. A clamp according to claim 3, in which the body portion is split such that each part supports a different one of said contact pieces and resiliently accommodates any misalignment when the electrode is clamped in position.

* * * * *